US011959683B2

(12) United States Patent
Lorang et al.

(10) Patent No.: US 11,959,683 B2
(45) Date of Patent: Apr. 16, 2024

(54) MODULATING REFRIGERATION SYSTEM WITH SECONDARY EQUIPMENT

(71) Applicant: Therma-Stor LLC, Madison, WI (US)

(72) Inventors: Grant M. Lorang, Cottage Grove, WI (US); Gustavo Daniel Olivera, Winter Garden, FL (US); Weizhong Yu, Cottage Grove, WI (US); David Treleven, Raleigh, NC (US); Todd R. DeMonte, Sun Prairie, WI (US); Robert John Motiff, Columbus, WI (US); Timothy S. O'Brien, DeForest, WI (US)

(73) Assignee: THERMA-STOR LLC, Madison, WI (US)

( * ) Notice: Subject to any disclaimer, the term of this patent is extended or adjusted under 35 U.S.C. 154(b) by 156 days.

(21) Appl. No.: 17/649,038

(22) Filed: Jan. 26, 2022

(65) Prior Publication Data

US 2023/0296292 A1 Sep. 21, 2023

(51) Int. Cl.
*F25B 5/02* (2006.01)
*F25B 41/20* (2021.01)

(52) U.S. Cl.
CPC ..... *F25B 5/02* (2013.01); *F25B 41/20* (2021.01)

(58) Field of Classification Search
CPC .... F25B 5/02; F25B 41/20; F25B 6/02; F25B 6/00; F25B 5/00; F25B 41/22; F25B 41/26; F25B 41/40; F25B 41/42; F25B 13/00
See application file for complete search history.

(56) References Cited

U.S. PATENT DOCUMENTS

| | | | | |
|---|---|---|---|---|
| 6,826,921 | B1 * | 12/2004 | Uselton | F24F 11/81 62/176.5 |
| 2001/0037873 | A1 * | 11/2001 | Fredj | F25B 41/24 165/51 |
| 2004/0035133 | A1 * | 2/2004 | Park | F25B 13/00 62/324.1 |
| 2008/0104974 | A1 * | 5/2008 | Dieckmann | F25B 5/04 62/93 |
| 2018/0266709 | A1 * | 9/2018 | Tucker | F24F 3/153 |
| 2019/0128543 | A1 * | 5/2019 | Dingle | F24F 1/0063 |
| 2020/0191453 | A1 * | 6/2020 | Denison | F25B 39/04 |
| 2021/0025604 | A1 * | 1/2021 | Sloan | F25B 49/02 |
| 2021/0190336 | A1 * | 6/2021 | Yu | F25B 6/04 |
| 2021/0341192 | A1 * | 11/2021 | Matsusaka | F25B 5/02 |
| 2022/0186994 | A1 * | 6/2022 | Ha | F25B 5/02 |

(Continued)

FOREIGN PATENT DOCUMENTS

WO WO-2022083924 A1 * 4/2022

*Primary Examiner* — Miguel A Diaz
(74) *Attorney, Agent, or Firm* — Baker Botts L.L.P.

(57) ABSTRACT

A modulating refrigeration system includes an evaporation unit and a condensing unit. The evaporation unit generates a first output airflow comprising a lower temperature, a lower relative humidity, or both than a first supply airflow and directs the first output airflow into a building. The condensing unit generates a second output airflow at a higher temperature than a second supply airflow and discharges the second output airflow to an unconditioned space. The evaporation unit comprises a first valve operable to direct a portion of refrigerant to a secondary evaporator and primary evaporator or to direct the entire flow of refrigerant to the primary evaporator and bypassing the secondary evaporator.

20 Claims, 8 Drawing Sheets

(56) References Cited

U.S. PATENT DOCUMENTS

| | | | | |
|---|---|---|---|---|
| 2023/0106860 | A1* | 4/2023 | Thatte | F25B 41/20<br>62/238.7 |
| 2023/0152015 | A1* | 5/2023 | Lee | F25B 13/00<br>62/324.1 |

* cited by examiner

MODULATING REFRIGERATION SYSTEM WITH SECONDARY EQUIPMENT

TECHNICAL FIELD

This invention relates generally to refrigeration systems and more particularly to a modulating refrigeration system with secondary equipment.

BACKGROUND OF THE INVENTION

In certain situations, it is desirable to reduce the humidity of air within or supplied to a structure. It is also desirable to be able to control the amount of reheat an airflow receives after removing latent or sensible heat. Current refrigeration systems that consist of secondary coils are plumbed into a refrigerant flow path in an evaporation unit, thereby allowing for heat to transfer back into the airflow.

SUMMARY OF THE INVENTION

According to embodiments of the present disclosure, disadvantages and problems associated with previous systems may be reduced or eliminated.

In certain embodiments, a modulating refrigeration system comprises an evaporation unit disposed within a housing. The evaporation unit comprises a secondary evaporator operable to receive a flow of refrigerant discharged by a primary condenser disposed external to the housing, receive a first supply airflow introduced into the housing, and transfer heat from the first supply airflow to the flow of refrigerant as the first supply airflow passes through the secondary evaporator to generate a second airflow. The evaporation unit further comprises a primary metering device disposed upstream of the secondary evaporator and a first valve disposed upstream of the secondary evaporator operable to direct at least a first portion of the flow of refrigerant discharged by the primary condenser to the secondary evaporator. The evaporation unit further comprises a secondary metering device and a primary evaporator operable to receive the flow of refrigerant from the secondary metering device, receive the second airflow from the secondary evaporator, and transfer heat from the second airflow to the flow of refrigerant as the second airflow passes through the primary evaporator to generate a third airflow. The evaporation unit further comprises a secondary condenser operable to receive the flow of refrigerant from the secondary evaporator, receive the third airflow from the primary evaporator, and transfer heat from the flow of refrigerant to the third airflow as the third airflow passes through the secondary condenser to generate a first output airflow. The evaporation unit further comprises a compressor operable to receive the flow of refrigerant from the primary evaporator and provide the flow of refrigerant to the primary condenser, the flow of refrigerant provided to the primary condenser comprising a higher pressure than the flow of refrigerant received at the compressor.

The evaporation unit further comprises a reversing valve disposed between the compressor and the primary evaporator. During a first mode of operation, the reversing valve is configured to receive the flow of refrigerant from the primary evaporator and direct the flow of refrigerant to the compressor and receive the flow of refrigerant discharged by the compressor and direct the flow of refrigerant discharged by the compressor to the primary condenser. During a second mode of operation, the reversing valve is configured to receive the flow of refrigerant from the primary condenser and direct the flow of refrigerant to the compressor and receive the flow of refrigerant discharged by the compressor and direct the flow of refrigerant discharged by the compressor to the primary evaporator.

The modulating refrigeration system further comprises a condensing unit disposed external to the housing. The condensing unit comprises the primary condenser operable to receive the flow of refrigerant from the compressor, receive a second supply airflow, and transfer heat from the flow of refrigerant to the second supply airflow as the second supply airflow passes through the primary condenser to generate a second output airflow.

Certain embodiments of the present disclosure may provide one or more technical advantages. For example, certain embodiments include a modulating refrigeration system comprising a dehumidification system with a first valve upstream of the evaporator coils. This system may allow for a reduction in the amount of refrigerant that flows to a secondary evaporator and secondary condenser during a specific mode of operation. For example, during an air conditioning mode, the first valve may direct the entire refrigerant flow to a primary evaporator, thereby preventing any reheating as an airflow passes from the primary evaporator to the secondary condenser. During a dehumidification mode, the first valve may direct variable portions of refrigerant flow to both the secondary evaporator and primary evaporator. In this example, the sensible to latent cooling ratio may be modulated based on user preferences. These embodiments may increase the efficiency of refrigeration cycles by reducing or removing any reheating via the secondary condenser and by providing for modulation of the sensible to latent cooling ratio through the first valve.

As another example, certain embodiments include two evaporators, two condensers, and two metering devices that utilize a closed refrigeration loop. This configuration causes part of the refrigerant within the system to evaporate and condense twice in one refrigeration cycle, thereby increasing the compressor capacity over typical systems without adding any additional power to the compressor. This, in turn, increases the overall efficiency of the system by providing more dehumidification per kilowatt of power used. The lower humidity of the output airflow may allow for increased drying potential, which may be beneficial in certain applications (e.g., fire and flood restoration).

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

In certain situations, it is desirable to reduce the humidity of air within or supplied to a structure. It is also desirable not to reheat an airflow as sensible and latent heat is being removed from that airflow. Current refrigeration systems, however, have proven inadequate or inefficient in various respects. These systems can include secondary coils that are plumbed into a refrigerant flow path in an evaporation unit, thereby allowing for heat to transfer back into the airflow and reducing efficiency.

To address the inefficiencies and other issues with current refrigeration systems, the disclosed embodiments provide an modulating refrigeration system comprising a dehumidification system with a first valve upstream of the evaporator coils. Operating the first valve provides for a reduction in the amount of refrigerant that flows to a secondary evaporator and secondary condenser during a specific mode of operation. For example, during an air conditioning mode, the first valve may direct the entire refrigerant flow to a primary evaporator, thereby preventing any reheating as an airflow passes from the primary evaporator to the secondary condenser. During a dehumidification mode, the first valve may direct variable portions of refrigerant flow to both the secondary evaporator and primary evaporator. In this example, the sensible to latent cooling ratio may be modulated based on user preferences. The disclosed embodiments may increase the efficiency of refrigeration cycles by reducing or removing any reheating via the secondary condenser and by providing for modulation of the sensible to latent cooling ratio through the first valve.

Further, the dehumidification system causes part of the refrigerant within the multi-stage system to evaporate and condense twice in one refrigeration cycle. This increases the compressor capacity over typical systems without adding any additional power to the compressor. This, in turn, increases the overall efficiency of the system by providing more dehumidification per kilowatt of power used.

Modulating Refrigeration System

Figure 1:
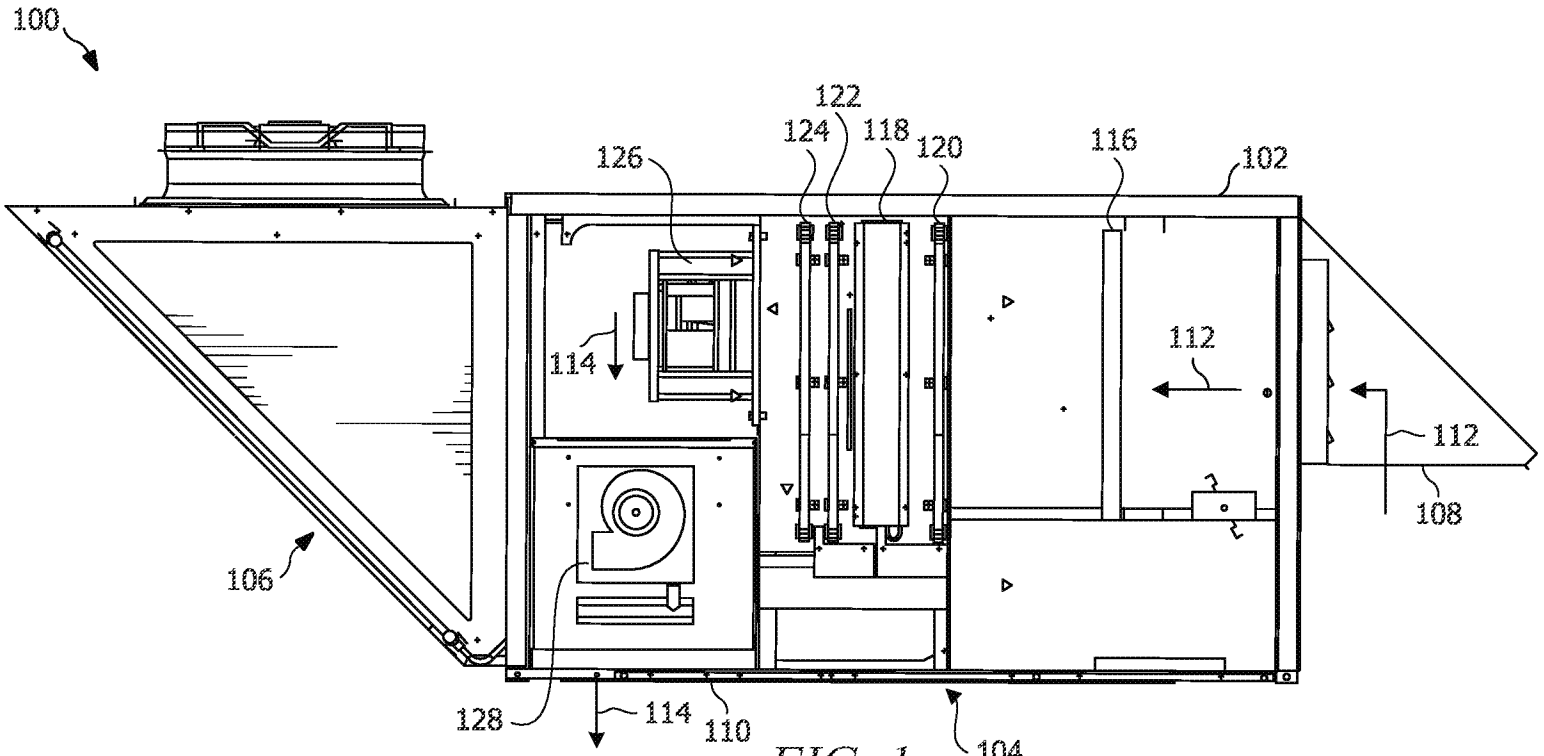
FIG. 1 illustrates a cross-section of an example modulating refrigeration system of FIG. 1, according to certain embodiments.
Figure 2:
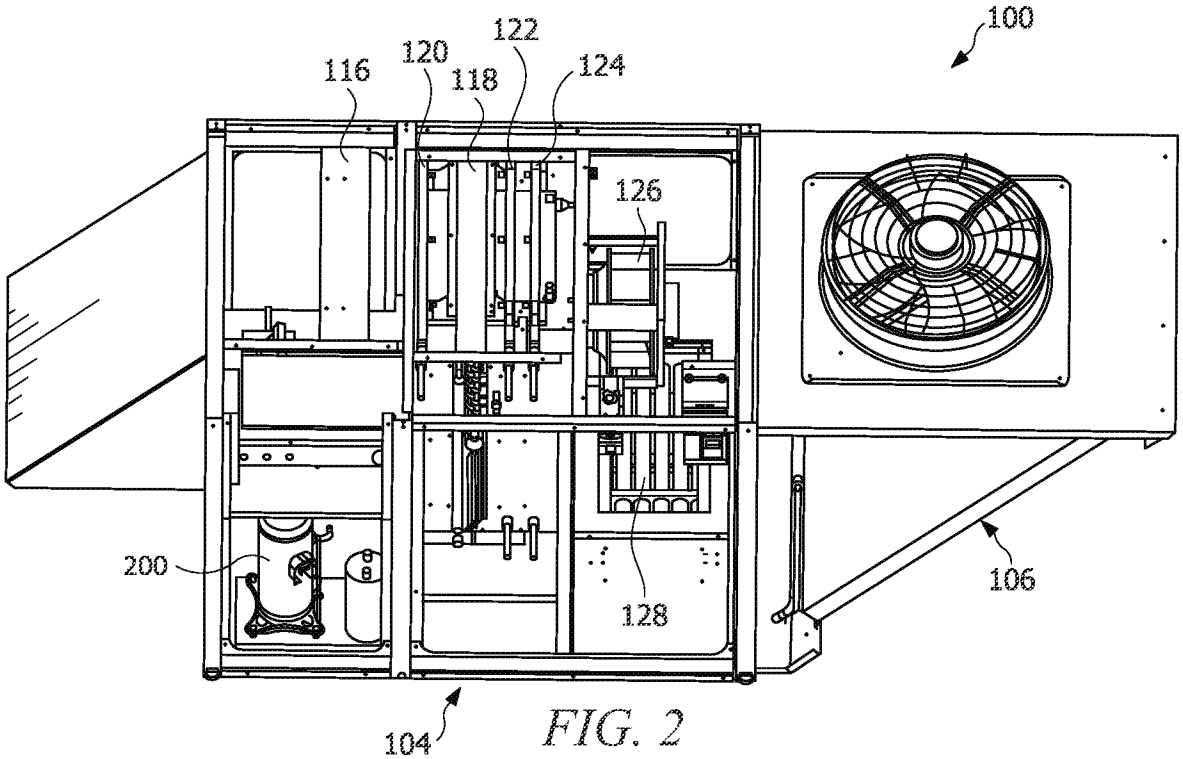
FIG. 2 illustrates an isometric, cross-sectional view of the example modulating refrigeration system of FIG. 1, according to certain embodiments.
Figure 3:
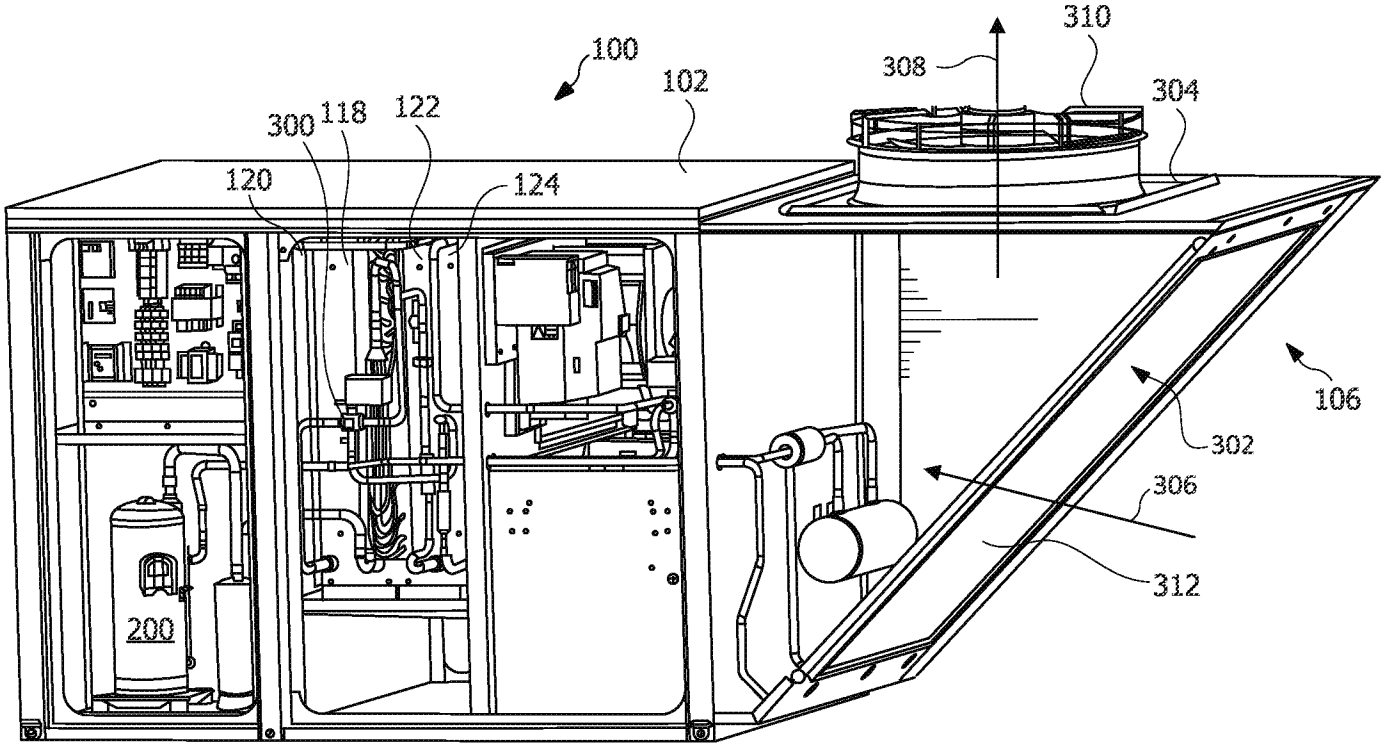
FIG. 3 illustrates a cross-section of the example modulating refrigeration system of FIG. 1, according to certain embodiments.

FIGS. 1-3 illustrate an example modulating refrigeration system 100 for lowering the temperature and/or a relative humidity of an airflow within or supplied to a structure (for example, a building), according to certain embodiments. FIG. 1 illustrates a cross-sectional view through one side of the example modulating refrigeration system 100. FIG. 2 illustrates an isometric, cross-sectional view of the example modulating refrigeration system 100. FIG. 3 illustrates a cross-sectional view through an opposing side of the example modulating refrigeration system 100 in comparison to FIG. 1. The structure may include all or a portion of a building or other suitable enclosed space, such as an apartment building, a hotel, an office space, a commercial building, or a private dwelling (e.g., a house). Modulating refrigeration system 100 may comprise a housing 102, an evaporation unit 104, and a condensing unit 106. The housing 102 may be operable to house and protect the internal components of the modulating refrigeration system 100 from an external environment. The housing 102 may comprise any suitable size, height, shape, and any combinations thereof. Further, the housing 102 may comprise any suitable materials, such as metals, nonmetals, polymers, composites, and any combinations thereof.

As best illustrated with reference to FIG. 1, the housing 102 may comprise an inlet 108 and an outlet 110 each disposed at one of the sides of the housing 102. The inlet 108 is configured to introduce a first supply airflow 112 into the housing 102, and the outlet 110 is configured to discharge a first output airflow 114 from the housing 102. The first supply airflow 112 may be received from an outside environment of unconditioned space. The first output airflow 114 may be discharged to be introduced into an interior of the structure of which the modulating refrigeration system 100 is coupled (for example, a building) after being conditioned by the modulating refrigeration system 100.

Referring back to FIGS. 1-3, the housing 102 may be operable to contain the evaporation unit 104. The evaporation unit 104 may comprise a first filter 116, a primary evaporator 118, a secondary evaporator 120, a secondary condenser 122, a sub-cooling coil 124, a first fan 126, and a supplemental heater 128. The first filter 116 may be any suitable filter operable to remove particulates from an airflow. For example, as the first supply airflow 112 is introduced into the housing 102, particulates may be removed as the first supply airflow 112 flows through the first filter 116. The first filter 116 may be disposed proximate to the inlet 108 and upstream of each of the coils of the evaporation unit 104.

In certain embodiments, operation of the primary evaporator 118, secondary evaporator 120, secondary condenser 122, and sub-cooling coil 124 may generate the first output airflow 114. Each of the primary evaporator 118, secondary evaporator 120, secondary condenser 122, and sub-cooling coil 124 may be any type of heat exchanger coil (e.g., fin tube, micro channel, etc.) operable to transfer heat between a flow of refrigerant and a surrounding airflow. Primary evaporator 118, secondary evaporator 120, secondary condenser 122, and sub-cooling coil 124 are described in more detail below in FIGS. 5A-6B.

Evaporation unit 104 may be installed in series with an air mover. An air mover may include the first fan 126 that blows air from one location to another. The first fan 126 may facilitate distribution of outgoing air from evaporation unit 104 to various parts of the structure. An air mover and evaporation unit 104 may have separate return inlets from which air is drawn. In certain embodiments, outgoing air from evaporation unit 104 (for example, first output airflow 114) may be mixed with air produced by another component (e.g., an air conditioner) and blown through air ducts by the first fan 126. In other embodiments, evaporation unit 104 may perform both cooling and dehumidifying and thus may be used without a conventional air conditioner. As shown, the first fan 126 may be disposed downstream of the secondary condenser 122 or downstream of the optional sub-cooling coil 124. The first fan 126 may be disposed about any suitable location throughout the housing 102 while remaining operable to direct the first supply airflow 112 to flow into the housing 102 and through the evaporation unit 104 and to direct the generated first output airflow 114 out of the housing 102. As illustrated, the first output airflow 114 may be discharged from the evaporation unit 104. First output airflow 114 may be at a temperature lower than, approximately the same as, or greater than the first supply airflow 112 introduced into the housing 102 of the modulating refrigeration system 100, depending on the mode of operation of the modulating refrigeration system 100.

In certain embodiments, the supplemental heater 128 may be disposed within the evaporation unit 104. The supplemental heater 128 may be an optional component that is not fluidly coupled to the remaining components of the evaporation unit 104 (i.e., the primary evaporator 118, secondary evaporator 120, secondary condenser 122, etc.). The supplemental heater 128 may be disposed proximate to the outlet 110 of the housing 102 and operable to provide additional heat to the first output airflow 114, if needed. For example, if the first output airflow 114 is generated at a lower temperature than that designated by a user, the supplemental heater 128 may be actuated to transfer heat to the first output airflow 114 to increase the temperature of the first output airflow 114 before the first output airflow 114 is discharged back into the structure. Any suitable heat exchanger may be utilized as the supplemental heater 128.

As best illustrated with reference to FIGS. 2-3, the evaporation unit 104 may further comprise a compressor 200. The compressor 200 may be operable to receive refrigerant discharged by the primary evaporator 118 and pressurize the received refrigerant for use by the condensing unit 106. In certain embodiments, the compressor 200 may be included in the condensing unit 106 rather than in the evaporation unit 104. Compressor 200 is described in more detail below in FIGS. 5A-6B.

With reference to FIG. 3, the evaporation unit 104 may further comprise a first valve 300. The first valve 300 may be disposed upstream of the secondary evaporator 120 operable to direct at least a first portion of a flow of refrigerant discharged by the condensing unit 106 to the secondary evaporator 120. In embodiments, a second portion of the flow of refrigerant discharged by the condensing unit 106 may be directed, by the first valve 300, to the primary evaporator 118. Without limitations, any suitable type of valve may be used as the first valve 300. First valve 300 is described in more detail below in FIGS. 4-6B.

As illustrated, the evaporation unit 104 may be disposed within the housing 102, and the condensing unit 106 may be disposed external to the housing 106. In embodiments, the condensing unit 106 may be disposed adjacent to or coupled to the housing 102. The condensing unit 106 may comprise an inlet 302 and an outlet 304. The inlet 302 is configured to introduce a second supply airflow 306 into the condensing unit 106, and the outlet 304 is configured to discharge a second output airflow 308 from the condensing unit 106. In embodiments, the second supply airflow 306 may be received from an outside environment of unconditioned space, and the second output airflow 308 may be discharged back to the outside environment of unconditioned space at a higher temperature in order to reject head absorbed by the evaporation unit 104.

The condensing unit 106 may further comprise a second fan 310 that blows air from one location to another. As shown, the second fan 310 may be disposed at the outlet 304 of condensing unit 106. The second fan 310 may be disposed about any suitable location while remaining operable to direct the second supply airflow 306 to flow into the condensing unit 106 and to direct the generated second output airflow 308 out of the condensing unit 106. Second output airflow 308 may be at a temperature greater than the second supply airflow 306 introduced into the condensing unit 106 of the modulating refrigeration system 100.

The condensing unit 106 may further comprise a primary condenser 312. In embodiments, operation of the primary condenser 312 may generate the second output airflow 308. The primary condenser 312 may be any type of heat exchanger coil (e.g., fin tube, micro channel, etc.) operable to transfer heat between a flow of refrigerant and a surrounding airflow (for example, the second supply airflow 306). The primary condenser 312 may be fluidly coupled with one or more components of the evaporation unit 104. For example, the primary condenser 312 may be operable to receive refrigerant from the compressor 200 and discharge refrigerant to the first valve 300, wherein the refrigerant may flow to the secondary evaporator 120 and/or the primary evaporator 118. Primary condenser 312 is described in more detail below in FIGS. 5A-6B.

The combination of both the evaporation unit 104 and condensing unit 106 may operate as a dehumidification system. The evaporation unit 104 may receive an airflow (such as the first supply airflow 112 of FIG. 1), reduce the temperature and moisture in the received airflow, and supply dehumidified air (such as the first output airflow 114 of FIG. 1) back to the structure. The condensing unit 106 may be fluidly coupled to the evaporation unit 104 and operate to reject the absorbed heat to an unconditioned environment external to the structure.

In general, the dehumidification system is a split system comprising the evaporation unit 104 coupled to a remote condensing unit 106. Remote condensing unit 106 may facilitate the functions of evaporation unit 104 by processing a flow of refrigerant as part of a refrigeration cycle. The flow of refrigerant may include any suitable cooling material, such as R410*a* refrigerant. In other embodiments, condensing unit 106 may receive the flow of refrigerant already pressurized from compressor 200. Condensing unit 106 may then condense pressurized refrigerant by facilitating heat transfer from the flow of refrigerant to the ambient air. In certain embodiments, condensing unit 106 may utilize a heat exchanger, such as a microchannel heat exchanger, to remove heat from the flow of refrigerant (for example, primary condenser 312). Remote condensing unit 106 may include a fan (for example, second fan 310) that draws the ambient air for use in for cooling the flow of refrigerant. In certain embodiments, the speed of this fan is modulated to effectuate desired operating characteristics.

After being cooled and condensed to liquid by condensing unit 106, the flow of refrigerant may travel by a refrigerant line to evaporation unit 104. In certain embodiments, the flow of refrigerant may be received by an expansion device (described in further detail below) that reduces the pressure of the flow of refrigerant, thereby reducing the temperature of the flow of refrigerant. Evaporation unit 104 may receive the flow of refrigerant from the expansion device and use the flow of refrigerant to dehumidify and cool an incoming airflow (such as the first supply airflow 12). The flow of refrigerant may then flow back to remote condensing unit 106 and repeat this cycle.

Operation of the dehumidification system may lower the level of moisture content of an airflow before that airflow is discharged from the modulating refrigeration system 100 and introduced back into the structure. The split configuration of the dehumidification system may allow heat from the cooling and dehumidification process to be rejected outdoors or to an unconditioned space (e.g., external to a space being dehumidified), such as to the external environment.

Although a particular implementation of modulating refrigeration system 100 is illustrated and primarily described, the present disclosure contemplates any suitable implementation of modulating refrigeration system 100, according to particular needs. Moreover, although various components of modulating refrigeration system 100 have been depicted as being located at particular positions, the present disclosure contemplates those components being positioned at any suitable location, according to particular needs.

Figure 4:
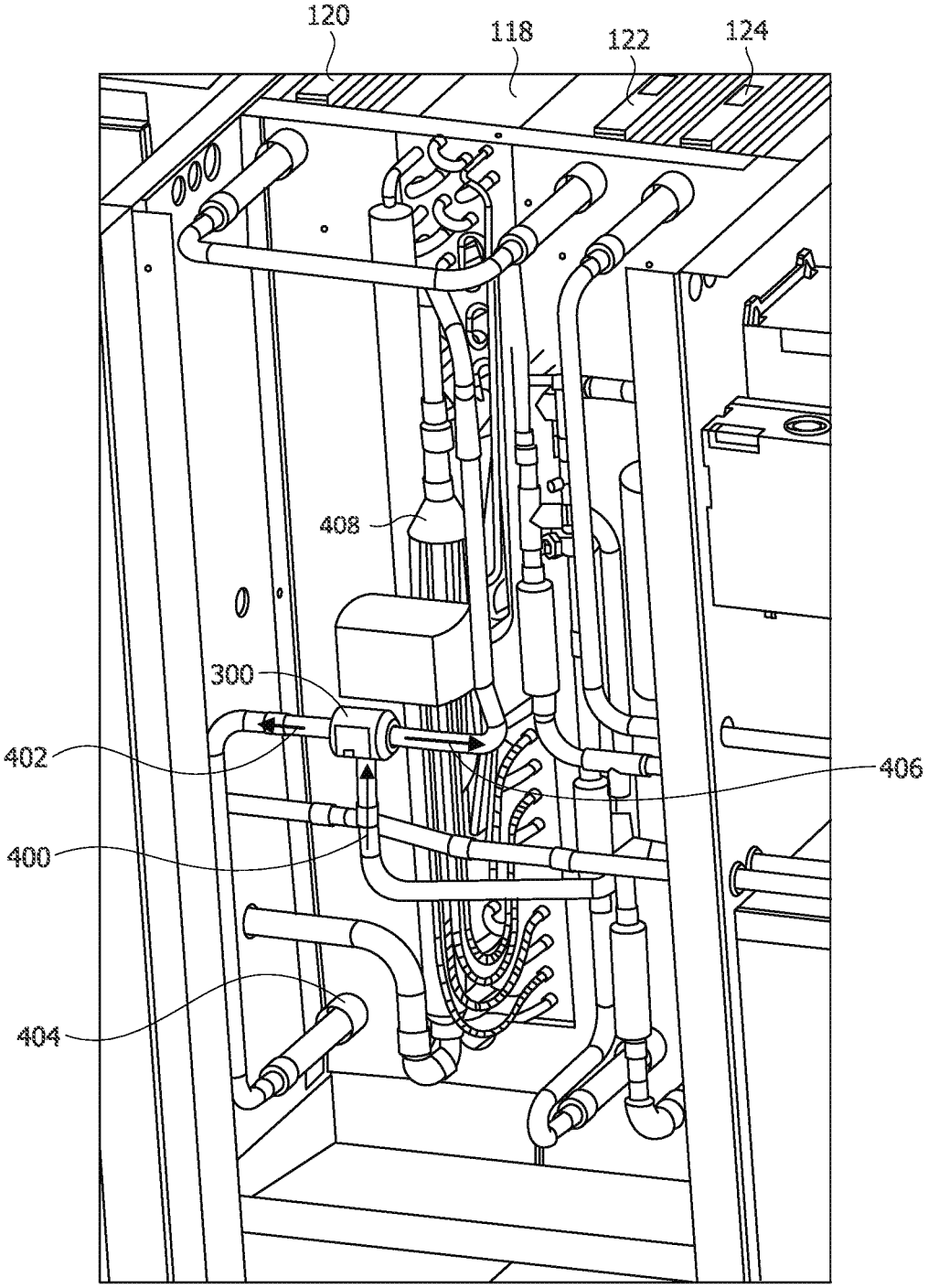
FIG. 4 illustrates a cross-section of the example modulating refrigeration system of FIG. 1 with an example valve, according to certain embodiments.

FIG. 4 illustrates a cross-section of the example modulating refrigeration system 100 of FIG. 3 with the example first valve 300, according to certain embodiments. In embodiments, the first valve 300 may be a three-way valve disposed upstream of the secondary evaporator 120 and primary evaporator 118. The first valve 300 may be operable to receive a flow of refrigerant 400 from the primary condenser 312 (referring to FIG. 3) of the condensing unit 106 (referring to FIG. 3) and direct a portion of the received flow of refrigerant to the secondary evaporator 120 and/or to the primary evaporator 118. As illustrated, a first portion 402 of the received flow of refrigerant 400 may be discharged from the first valve 300 to flow to an inlet 404 to the secondary evaporator 120, and a second portion 406 of the received flow of refrigerant 400 may be discharged from the first valve 300 to flow to an inlet 408 to the primary evaporator 118.

Depending on a mode of operation of the modulating refrigeration system 100, the first valve 300 may be operable to direct the entire flow of refrigerant 400 received from the primary condenser 312 to either the secondary evaporator 120 or the primary evaporator 118. In other embodiments, the first and second portions 402, 406 may be directed individually to the secondary evaporator 120 and primary evaporator 118. In these embodiments, the first and second portions 402, 406 may be any suitable value between 0-100% of the received flow of refrigerant 400 from the primary condenser 312, wherein the combined flow of the first and second portions 402, 406 is equivalent to the received flow of refrigerant 400 from the primary condenser 312. For example, the first portion 402 may be 30% of the received flow of refrigerant 400 from the primary condenser 312, and the second portion 406 may be 70% of the received flow of refrigerant 400 from the primary condenser 312.

Although a particular implementation of first valve 300 is illustrated and primarily described, the present disclosure contemplates any suitable implementation of first valve 300, according to particular needs. Moreover, although various components of first valve 300 have been depicted as being located at particular positions, the present disclosure contemplates those components being positioned at any suitable location, according to particular needs.

Modulating Refrigeration System with a Three-Way Valve in a First Mode

Figure 5A:
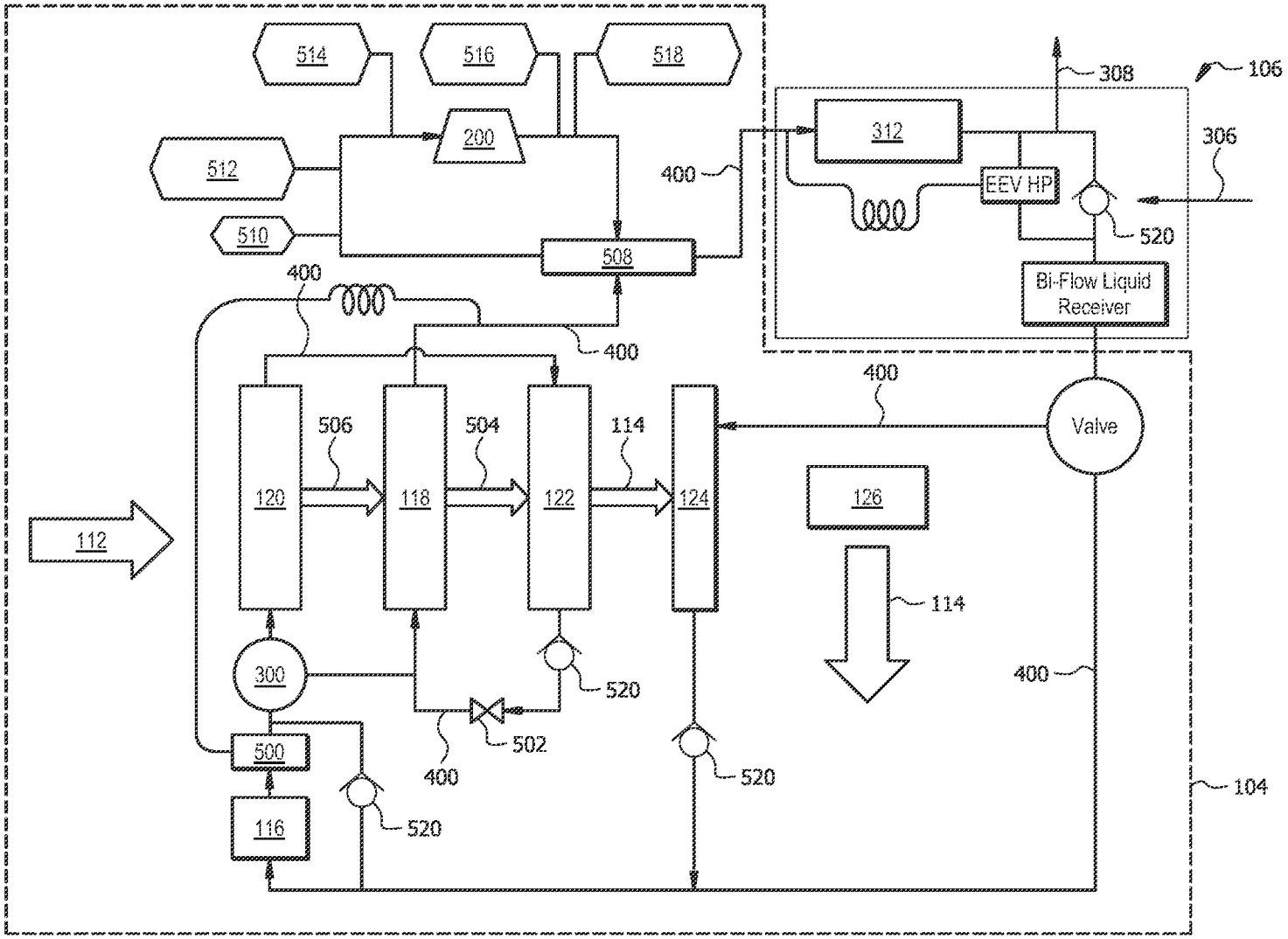
FIG. 5A illustrates a block diagram of the example modulating refrigeration system of FIG. 1 in a first mode of operation, according to certain embodiments.

FIG. 5A illustrates a block diagram of the example modulating refrigeration system 100 of FIG. 1 in a first mode of operation, according to certain embodiments. In embodiments, the first mode of operation may be an air conditioning and/or dehumidification mode. For the air conditioning mode, the modulating refrigeration system 100 may generate the first output airflow 114, from the first supply airflow 112, that comprises a lower temperature than the ambient air within a structure (i.e., a building). For the dehumidification mode, the modulating refrigeration system 100 may generate the first output airflow 114, from the first supply airflow 112, that comprises a lower relative humidity or moisture content than the ambient air within the structure (i.e., a building). In general, the illustrated evaporation unit 104 receives an inlet airflow (first supply airflow 112), removes water from that inlet airflow, and discharges dehumidified air into a conditioned space (into the structure). Water is removed from the inlet air using a refrigeration cycle of a flow of refrigerant 400. The split configuration of the dehumidification system, which includes the evaporation unit 104 and condensing unit 106, allows heat from the cooling and dehumidification process to be rejected outdoors or to an unconditioned space (e.g., external to a space being dehumidified). This allows the dehumidification system to have a similar footprint to that of typical central air conditioning systems or heat pumps. Accordingly, the dehumidification system may perform functions of both a dehumidifier (dehumidifying air) and a central air conditioner (cooling air). In the combined mode of operation, the generated first output airflow 114 may comprise both a lower temperature and lower relative humidity than the ambient air within the structure.

As illustrated in FIG. 5A, evaporation unit 104 includes the primary evaporator 118, the secondary evaporator 120, the secondary condenser 122, the compressor 200, a primary metering device 500, a secondary metering device 502, the optional sub-cooling coil 124, and the first fan 126, while condensing unit 106 includes the primary condenser 312. In an embodiment, the compressor 200 may be disposed within the condensing unit 106 rather than disposed within the evaporation unit 104.

With reference to FIG. 5A, a flow of refrigerant 400 is circulated through the evaporation unit 104 and condensing unit 106 as illustrated. By including secondary evaporator 120 and secondary condenser 122, this dehumidification system causes at least part of the flow of refrigerant 400 to evaporate and condense twice in a single refrigeration cycle. This increases refrigerating capacity over typical systems without requiring any additional power to the compressor, thereby increasing the overall efficiency of the system.

In general, operation of the evaporation unit 104 and condensing unit 106 attempts to match the saturating temperature of secondary evaporator 120 to the saturating temperature of secondary condenser 122. As the saturating temperature of secondary evaporator 120 is lower than the first supply airflow 112 introduced through the evaporation unit 104, evaporation happens in secondary evaporator 120. As the saturating temperature of secondary condenser 122 is higher than a third airflow 504 after flowing through the primary evaporator 118, condensation happens in secondary condenser 122. The amount of refrigerant 400 evaporating in secondary evaporator 120 is substantially equal to that condensing in secondary condenser 122.

Primary evaporator 118 receives flow of refrigerant 400 from secondary metering device 502 and outputs flow of refrigerant 400 to compressor 200. Primary evaporator 118 may be any type of coil (e.g., fin tube, micro channel, etc.). Primary evaporator 118 receives a second airflow 506 generated from secondary evaporator 120 and generates and outputs the third airflow 504 to secondary condenser 122 at a lower temperature. To cool incoming second airflow 506, primary evaporator 118 transfers heat from second airflow 506 to flow of refrigerant 400, thereby causing flow of refrigerant 400 to evaporate at least partially from liquid to gas. This transfer of heat from second airflow 506 to flow of refrigerant 400 also removes water from second airflow 506.

Secondary condenser 122 receives flow of refrigerant 400 from secondary evaporator 120 and outputs flow of refrigerant 400 to secondary metering device 502. Secondary condenser 122 may be any type of coil (e.g., fin tube, micro channel, etc.). Secondary condenser 122 receives third airflow 504 from primary evaporator 118 and generates and outputs first output airflow 114 that is warmer and drier (i.e., the dew point will be the same but relative humidity will be lower) than the received third airflow 504. Secondary condenser 122 generates a warmer and drier first output airflow 114 by transferring heat from flow of refrigerant 400 to the received third airflow 504, thereby causing flow of refrigerant 400 to condense at least partially from gas to liquid.

In embodiments, first output airflow 114 may be output into the conditioned space. In other embodiments, first output airflow 114 may first pass through and/or over sub-cooling coil 124 before being output into the conditioned space at a further decreased relative humidity.

As shown in FIG. 5A, refrigerant 400 then flows from primary evaporator 118 to compressor 200. Alternatively, the refrigerant 400 may continue to flow to the compressor 200 within the condensing unit 106. Compressor 200 pressurizes flow of refrigerant 400, thereby increasing the temperature of refrigerant 400. For example, if flow of refrigerant 400 entering compressor 200 is 128 psig/52° F./100% vapor, flow of refrigerant 400 may be 340 psig/150° F./100% vapor as it leaves compressor 200. Compressor 200 receives flow of refrigerant 400 from primary evaporator 118 and supplies the pressurized flow of refrigerant 400 to primary condenser 312.

In embodiments, a reversing valve 508 may be disposed between the primary evaporator 118 and compressor 200. Without limitations, any suitable type of valve may be used as the reversing valve 508. The reversing valve 508 may be operable to transition the modulating refrigeration system 100 from the first mode of operation to a second mode of operation. In embodiments, the second mode of operation may be a heat pump mode. During the first mode of operation, the reversing valve 508 may be configured to receive the flow of refrigerant 400 from the primary evaporator 118 and direct the flow of refrigerant 400 to the compressor 200 to be pressurized. The reversing valve 508 may then receive the flow of refrigerant 400 discharged by the compressor 200 and direct the flow of refrigerant 400 discharged by the compressor 200 to the primary condenser 312 in the condensing unit 106. During the second mode of operation, the reversing valve 508 may be configured to receive the flow of refrigerant 400 from the primary condenser 312 and direct the flow of refrigerant 400 to the compressor 200. The reversing valve 508 may then receive the flow of refrigerant 400 discharged by the compressor 200 and direct the flow of refrigerant 400 discharged by the compressor 200 to the primary evaporator 118.

Primary condenser 312 receives flow of refrigerant 400 from reversing valve 508 and outputs flow of refrigerant 400 back to evaporation unit 104. Primary condenser 312 may be any type of coil (e.g., fin tube, micro channel, etc.). Primary condenser 312 receives the second supply airflow 306 and outputs second output airflow 308. Second output airflow 308 may be, in general, warmer (i.e., has a lower relative humidity) than first output airflow 114. Primary condenser 312 transfers heat from flow of refrigerant 400, thereby causing flow of refrigerant 400 to condense at least partially from gas to liquid. In some embodiments, primary condenser 312 completely condenses flow of refrigerant 400 to a liquid (i.e., 100% liquid). In other embodiments, primary condenser 312 partially condenses flow of refrigerant 400 to a liquid (i.e., less than 100% liquid).

Sub-cooling coil 124, which is an optional component of the dehumidification system, may sub-cool the liquid refrigerant 400 as it leaves primary condenser 312. This, in turn, supplies primary metering device 500 with a liquid refrigerant that is 25 degrees (or more) cooler than before it enters sub-cooling coil 124. For example, if flow of refrigerant 400 entering sub-cooling coil 124 is 340 psig/105° F./60% vapor, flow of refrigerant 400 may be 340 psig/80° F./0% vapor as it leaves sub-cooling coil 124. The sub-cooled refrigerant 400 has a greater heat enthalpy factor as well as a greater density, which improves energy transfer between airflow and evaporator resulting in the removal of further latent heat from refrigerant 400. This further results in greater efficiency and less energy use of the dehumidification system. Embodiments of the dehumidification system may or may not include a sub-cooling coil 124. In certain embodiments, sub-cooling coil 124 and primary evaporator 118 are combined into a single coil. Such a single coil includes appropriate circuiting for flow of air and refrigerant 400.

In embodiments, the first valve 300 may be disposed upstream of the secondary evaporator 120 operable to direct at least a portion of the flow of refrigerant 400 discharged by the primary condenser 312 to the secondary evaporator 120. As illustrated, the first valve may be a three-way valve disposed between the primary metering device 500 and the secondary evaporator 120. During the first mode of operation, the first valve 300 may be configured to receive a flow of refrigerant 400 discharged by the primary condenser 312, and optionally by the sub-cooling coil 124. The first valve 300 may then direct the first portion 402 (referring to FIG. 4) of the flow of refrigerant 400 to the secondary evaporator 120 and direct the second portion 406 (referring to FIG. 4) of the flow of refrigerant 400 to the primary evaporator 118.

Depending on the type of first mode of operation (i.e., air conditioning, dehumidification, or a combination of both), the first valve 300 may direct the entire received flow of refrigerant 400 from the primary condenser to the primary evaporator 118 and inhibit refrigerant 400 from flowing to the secondary evaporator 120 and secondary condenser 122. In this embodiment, the generated third airflow 504 from the primary evaporator 118 will not be heated by the secondary condenser 122 as the third airflow 504 flow past the secondary condenser 122. In other embodiments, the first valve 300 may direct the first and second portions 402, 406 to the secondary evaporator 120 and primary evaporator 118, respectively. While there may be an increase in the temperature of the generated third airflow 504 in this embodiment, the present configuration may reduce the amount of temperature increase in the generated third airflow 504 compared to existing refrigeration systems comprising the secondary evaporator 120 and secondary condenser 122 being plumbed into the refrigerant flow path.

Secondary evaporator 120 receives flow of refrigerant 400 from first valve 300 and outputs flow of refrigerant 400 to secondary condenser 122. Secondary evaporator 120 may be any type of coil (e.g., fin tube, micro channel, etc.). Secondary evaporator 120 receives the first supply airflow 112 and generates and outputs second airflow 506 to primary evaporator 118. Second airflow 506, in general, is at a cooler temperature than the first supply airflow 112. To cool the incoming first supply airflow 112, secondary evaporator 120 transfers heat from the first supply airflow 112 to flow of refrigerant 400, thereby causing flow of refrigerant 400 to evaporate at least partially from liquid to gas.

In certain embodiments, the secondary evaporator 120, primary evaporator 118, and secondary condenser 122 are combined in a single coil pack. The single coil pack may include portions (e.g., separate refrigerant circuits) to accommodate the respective functions of secondary evaporator 120, primary evaporator 118, and secondary condenser 122, described above. In embodiments, the primary evaporator 118 is located between the secondary evaporator 120 and secondary condenser 118 of the single coil pack. In general, single coil pack can include the same or a different coil type compared to that of primary evaporator 118. For example, single coil pack may include a microchannel coil type, while primary evaporator 118 may include a fin tube coil type. This may provide further flexibility for optimizing a dehumidification system in which single coil pack and primary evaporator 118 are used.

In certain embodiments, one or both of the secondary evaporator 120 and primary evaporator 118 are subdivided into two or more circuits. In such embodiments, each circuit of the subdivided evaporator(s) is fed refrigerant by a corresponding metering device. The metering devices may include passive metering devices, active metering devices, or combinations thereof. For example, metering device 500 may be an active electronic expansion valve (EEV) or thermostatic expansion valve (TXV) and secondary metering device 502 may be a passive fixed orifice device (or vice versa). The metering devices may be configured to feed refrigerant to each circuit within the evaporators at a desired mass flow rate. Metering devices for feeding refrigerant to each circuit of the subdivided evaporator(s) may be used in combination with metering devices 500, 502 or may replace one or both of metering devices 500, 502.

Fan 126 may include any suitable components operable to draw the first supply airflow 112 into evaporation unit 104 and through secondary evaporator 120, primary evaporator 118, and secondary condenser 122. Fan 126 may be any type of air mover (e.g., axial fan, forward inclined impeller, and backward inclined impeller, etc.). For example, fan 126 may be a backward inclined impeller positioned downstream of or adjacent to secondary condenser 122. While fan 126 is depicted as being located adjacent to condenser 122, it should be understood that fan 126 may be located anywhere along the airflow path of evaporation unit 104.

The rate of airflow generated by fan 126 may be different than that generated by fan 310 (referring to FIG. 3). For example, the flow rate of an airflow generated by fan 310 may be higher than the flow rate of an airflow generated by fan 126. This difference in flow rates may provide several advantages for the dehumidification systems described herein. For example, a large airflow generated by fan 310 may provide for improved heat transfer at the primary condenser 312 of the condensing unit 106.

Primary metering device 500 and secondary metering device 502 are any appropriate type of metering/expansion device. In some embodiments, primary metering device 500 is an electronic expansion valve (EEV) or thermostatic expansion valve (TXV) and secondary metering device 502 is a fixed orifice device (or vice versa). The primary metering device 500 and/or secondary metering device 502 may support bi-directional flow within the evaporation unit 104. In certain embodiments, metering devices 500 and 502 remove pressure from flow of refrigerant 400 to allow expansion or change of state from a liquid to a vapor in evaporators 118 and 120. The high-pressure liquid (or mostly liquid) refrigerant entering metering devices 500 and 502 is at a higher temperature than the liquid refrigerant 400 leaving metering devices 500 and 502. For example, if flow of refrigerant 400 entering primary metering device 500 is 340 psig/80° F./0% vapor, flow of refrigerant 400 may be 196 psig/68° F./5% vapor as it leaves primary metering device 500. As another example, if flow of refrigerant 400 entering secondary metering device 502 is 196 psig/68° F./4% vapor, flow of refrigerant 400 may be 128 psig/44° F./14% vapor as it leaves secondary metering device 502.

In certain embodiments, secondary metering device 502 is operated in a substantially open state (referred to herein as a "fully open" state) such that the pressure of refrigerant 400 entering metering device 502 is substantially the same as the pressure of refrigerant 400 exiting metering device 400. For example, the pressure of refrigerant 400 may be 80%, 90%, 95%, 99%, or up to 100% of the pressure of refrigerant 400 entering metering device 502. With the secondary metering device 502 operated in a "fully open" state, primary metering device 500 is the primary source of pressure drop in the dehumidification system. In this configuration, third airflow 504 is not substantially heated when it passes through secondary condenser 122, and the secondary evaporator 120, primary evaporator 118, and secondary condenser 122 effectively act as a single evaporator. Although, less water may be removed from the initially received air when the secondary metering device 502 is operated in a "fully open" state, first output airflow 114 will be output to the conditioned space at a lower temperature than when secondary metering device 502 is not in a "fully open" state. This configuration corresponds to a relatively high sensible heat ratio (SHR) operating mode such that the dehumidification system may produce a cooler first output airflow 114 with properties similar to those of an airflow produced by a central air conditioner. If the rate of the incoming first supply airflow 112 is increased to a threshold value (e.g., by increasing the speed of fan 126 or one or more other fans of the dehumidification system), the dehumidification system may perform sensible cooling without removing water from that airflow.

As illustrated, the evaporation unit 104 may further comprise a plurality of sensors, wherein a mode of operation may be determined and initiated based on one or more measurements provided by a sensor. The evaporation unit 104 may comprise a temperature sensor 510, a first switch 512, a first pressure sensor 514, a second pressure sensor 516, and a second switch 518. The temperature sensor 510 may be a sensor operable to determine a temperature measurement at a location. The temperature sensor 510 may be disposed between the reversing valve 508 and the compressor 200 at a suction side of the compressor 200. The temperature sensor 510 may determine a temperature measurement of the refrigerant 400 flowing to the compressor 200.

The first and second switches 512, 518 may be safety switches operable to terminate operation of the evaporation unit 104. As illustrated, the first switch 512 may be disposed upstream of the compressor 200, and the second switch 518 may be disposed downstream of the compressor 200. During operations, each switch 512, 518 may be actuated based on a pressure measurement determined by the first and second pressure sensors 514, 516. In embodiments, if a pressure measurement exceeds a threshold at a location upstream or downstream of the compressor 200, the respective switch 512, 518 may actuate to stop operation in the evaporation unit 102. The first and second pressure sensors 514, 516 may each be a sensor operable to determine a pressure measurement at a location. The first pressure sensor 514 may be disposed upstream of the compressor 200, and the second pressure sensor 516 may be disposed downstream of the compressor 200.

Both the evaporation unit 104 and the condensing unit 106 may further comprise one or more check valves 520 disposed along the flow path of the refrigerant 400. The one or more check valves 520 may be operable to prevent the flow of refrigerant 400 in one direction between internal components of the evaporation unit 104 or condensing unit 106 but allow for the refrigerant 400 to flow in an opposing direction. In embodiments wherein the primary metering device 500 and/or secondary metering device 502 support bi-directional flow, a check valve 520 may not be needed to facilitate the flow of refrigerant 400 to and from other fluidly coupled components.

Refrigerant 400 may be any suitable refrigerant such as R410*a*. In general, the evaporation unit 104 and condensing unit 106 utilizes a closed refrigeration loop of refrigerant 400 that passes from compressor 200 through primary condenser 312, (optionally) sub-cooling coil 124, primary metering device 500, first valve 300, secondary evaporator 120, secondary condenser 122, secondary metering device 502, and primary evaporator 118. Compressor 200 pressurizes flow of refrigerant 400, thereby increasing the temperature of refrigerant 400. Primary and secondary condensers 312 and 122, which may include any suitable heat exchangers, cool the pressurized flow of refrigerant 400 by facilitating heat transfer from the flow of refrigerant 400 to the respective airflows passing through them (i.e., the second supply airflow 306 and third airflow 504).

The cooled flow of refrigerant 400 leaving primary and secondary condensers 312 and 122 may enter a respective expansion device (i.e., primary metering device 500 and secondary metering device 502) that is operable to reduce the pressure of flow of refrigerant 400, thereby reducing the temperature of flow of refrigerant 400. Primary and secondary evaporators 118 and 120, which may include any suitable heat exchanger, receive flow of refrigerant 400 from secondary metering device 502 and primary metering device 500, respectively. Primary and secondary evaporators 118 and 120 facilitate the transfer of heat from the respective airflows passing through them (i.e., second airflow 506 and first supply airflow 112) to flow of refrigerant 400. Flow of refrigerant 400, after leaving primary evaporator 118, passes through reversing valve 508 and back to compressor 200, and the cycle is repeated.

In certain embodiments, the above-described refrigeration loop may be configured such that evaporators 118 and 120 operate in a flooded state. In other words, flow of refrigerant 400 may enter evaporators 118 and 120 in a liquid state, and a portion of flow of refrigerant 400 may still be in a liquid state as it exits evaporators 118 and 120. Accordingly, the phase change of flow of refrigerant 400 (liquid to vapor as heat is transferred to flow of refrigerant 400) occurs across evaporators 118 and 120, resulting in nearly constant pressure and temperature across the entire evaporators 118 and 120 (and, as a result, increased cooling capacity).

In operation of example embodiments of the dehumidification system, the incoming first supply airflow 112 may be drawn into evaporation unit 104 by fan 126. The incoming first supply airflow 112 passes though secondary evaporator 120 in which heat is transferred from the air to the cool flow of refrigerant 400 passing through secondary evaporator 120. As a result, the first supply airflow 112 may be cooled. As an example, if the air is 80° F./60% humidity, secondary evaporator 120 may output second airflow 506 at 70° F./84% humidity. This may cause flow of refrigerant 400 to partially vaporize within secondary evaporator 120. For example, if flow of refrigerant 400 entering secondary evaporator 120 is 196 psig/68° F./5% vapor, flow of refrigerant 400 may be 196 psig/68° F./38% vapor as it leaves secondary evaporator 120.

The cooled air leaves secondary evaporator 120 as second airflow 506 and enters primary evaporator 118. Like secondary evaporator 120, primary evaporator 118 transfers heat from second airflow 506 to the cool flow of refrigerant 400 passing through primary evaporator 118. As a result, second airflow 506 may be cooled to or below its dew point temperature, causing moisture in second airflow 506 to condense (thereby reducing the absolute humidity of second airflow 506). As an example, if second airflow 506 is 70° F./84% humidity, primary evaporator 118 may output third airflow 504 at 54° F./98% humidity. This may cause flow of refrigerant 400 to partially or completely vaporize within primary evaporator 118. For example, if flow of refrigerant 400 entering primary evaporator 118 is 128 psig/44° F./14% vapor, flow of refrigerant 400 may be 128 psig/52° F./100% vapor as it leaves primary evaporator 118. In certain embodiments, the liquid condensate from second airflow 506 may be collected in a drain pan connected to a condensate reservoir. Additionally, the condensate reservoir may include a condensate pump that moves collected condensate, either continually or at periodic intervals, out of the evaporation unit 104 (e.g., via a drain hose) to a suitable drainage or storage location.

The third airflow 504 leaves primary evaporator 118 at a lower temperature and enters secondary condenser 122. Secondary condenser 122 facilitates heat transfer from the hot flow of refrigerant 400 passing through the secondary condenser 122 to third airflow 504. This reheats third airflow 504, thereby decreasing the relative humidity of third airflow 504. As an example, if third airflow 504 is 54° F./98% humidity, secondary condenser 122 may output first output airflow 114 at 65° F./68% humidity. This may cause flow of refrigerant 400 to partially or completely condense within secondary condenser 122. For example, if flow of refrigerant 400 entering secondary condenser 122 is 196 psig/68° F./38% vapor, flow of refrigerant 400 may be 196 psig/68° F./4% vapor as it leaves secondary condenser 122. In some embodiments, first output airflow 114 leaves secondary condenser 122 and is output to a conditioned space.

Primary condenser 312 facilitates heat transfer from the hot flow of refrigerant 400 passing through the primary condenser 312 to the second supply airflow 306. This heats the surrounding air, which is output to an unconditioned space (e.g., outdoors) as second output airflow 308. As an example, if the second supply airflow 306 is 65° F./68% humidity, primary condenser 312 may output second output airflow 308 at 102° F./19% humidity. This may cause flow of refrigerant 400 to partially or completely condense within primary condenser 312. For example, if flow of refrigerant 400 entering primary condenser 312 is 340 psig/150° F./100% vapor, flow of refrigerant 400 may be 340 psig/105° F./60% vapor as it leaves primary condenser 312.

Modulating Refrigeration System with the Three-Way Valve in a Second Mode

Figure 5B:
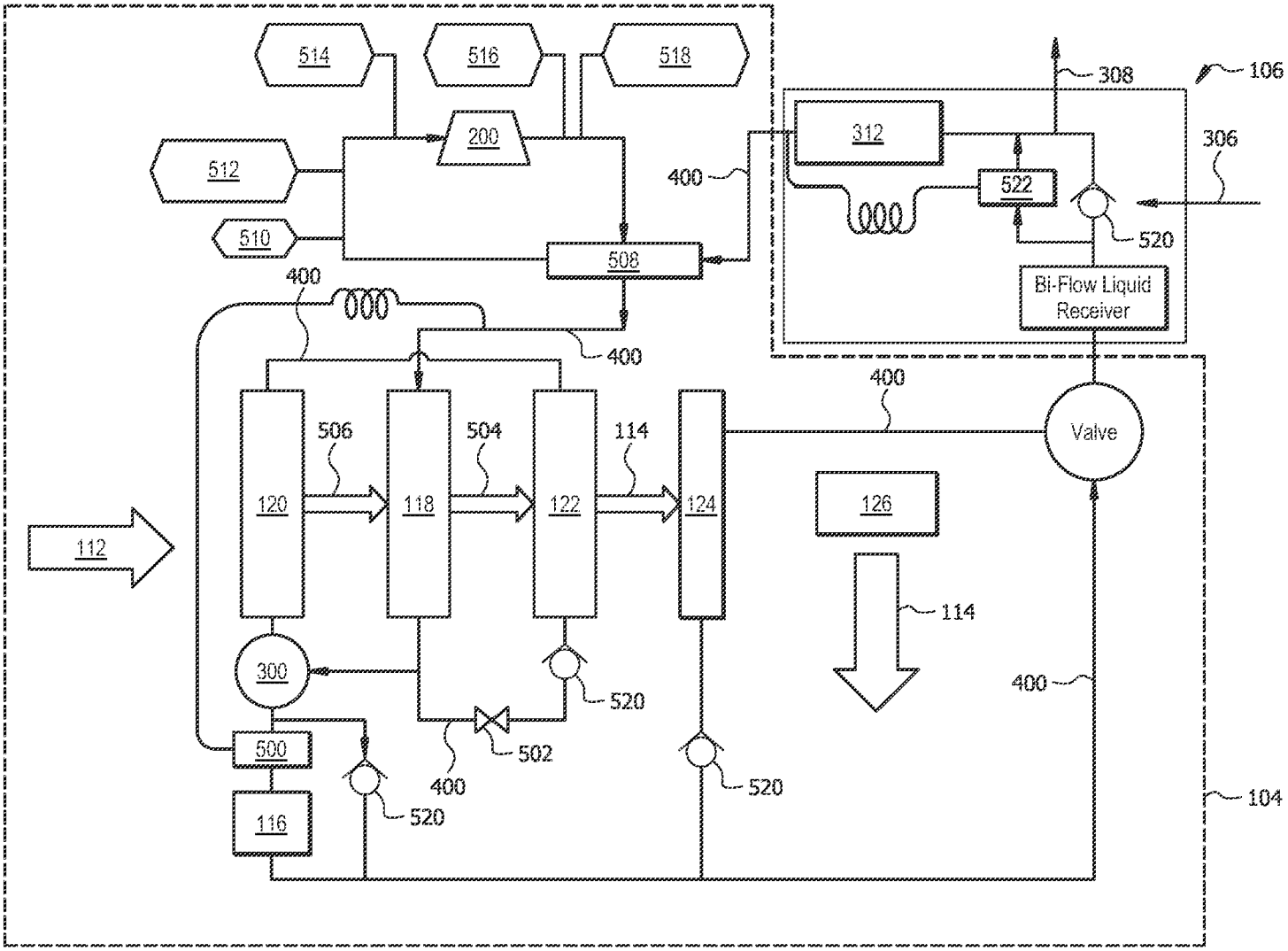
FIG. 5B illustrates a block diagram of the example modulating refrigeration system of FIG. 1 in a second mode of operation, according to certain embodiments.

FIG. 5B illustrates a block diagram of the example modulating refrigeration system 100 of FIG. 1 in a second mode of operation, according to certain embodiments. In embodiments, the second mode of operation may be a heat pump mode. As seen in FIG. 5B, evaporation unit 104 includes the primary evaporator 118, the secondary evaporator 120, the secondary condenser 122, the compressor 200, the primary metering device 500, the secondary metering device 502, the optional sub-cooling coil 124, the first fan 126, first valve 300, and the reversing valve 508, while condensing unit 106 includes the primary condenser 312. In an embodiment, the compressor 200 may be disposed within the condensing unit 106 rather than disposed within the evaporation unit 104.

Generally, primary evaporator 118, secondary evaporator 120, secondary condenser 122, compressor 200, primary metering device 500, secondary metering device 502, optional sub-cooling coil 124, first fan 126, first valve 300, reversing valve 508, and primary condenser 312 operate similarly as they did as illustrated in FIG. 5A. However, FIG. 5B illustrates the evaporation unit 104 and condensing unit 106 in the second mode of operation wherein the flow of refrigerant 400 is reversed compared to the flow of refrigerant 400 in FIG. 5A. In this manner, the first supply airflow 112 may be heated by the primary evaporator 118 to generate and output the first output airflow 114 with a higher temperature to be discharged into the structure. The present configuration further provides for mitigating additional cooling by the secondary condenser 122 by inhibiting flow of refrigerant 400 through the secondary condenser 122.

For example, the primary evaporator 118 may receive the flow of refrigerant 400 from the reversing valve 508. As the first supply airflow 112 flows past the primary evaporator 118, heat may transfer from the flow of refrigerant 400 to the first supply airflow 112 to generate the first output airflow 114 at a higher temperature. The flow of refrigerant 400 may then be discharged to flow to the first valve 300 and to one of the one or more check valves 520 disposed between the primary evaporator 118 and secondary condenser 122. That one of the one or more check valves 520 may inhibit the flow of refrigerant 400 from being introduced into the secondary condenser 122, and the refrigerant 400 may flow to the first valve 300. In embodiments, the first valve 300 may be in an open position to allow for the refrigerant 400 to flow through the first valve 300. The flow of refrigerant 400 may then bypass the primary metering device 500 and flow through one of the one or more check valves 520 disposed parallel to the primary metering device 500, wherein that check valve 520 discharges the flow of refrigerant 400 to an expansion device 522 used for heat pump mode and subsequently into condensing unit 106. The expansion device 522 may be similar to metering device 500 and provide bi-directional flow through the condensing unit 106. During this second mode of operation, the reversing valve 508 may receive the flow of refrigerant 400 from the primary condenser 312 and direct the flow of refrigerant 400 to the compressor 200. The reversing valve 508 may then receive the flow of refrigerant 400 discharged by the compressor 200 and direct the flow of refrigerant 400 discharged by the compressor 200 back to the primary evaporator 118.

Although a particular implementation of the evaporation unit 104 and condensing unit 106 is illustrated and primarily described, the present disclosure contemplates any suitable implementation of the evaporation unit 104 and condensing unit 106, according to particular needs. Moreover, although various components of the evaporation unit 104 and condensing unit 106 have been depicted as being located at particular positions, the present disclosure contemplates those components being positioned at any suitable location, according to particular needs.

Modulating Refrigeration System with a Solenoid Valve in a First Mode

Figure 6A:
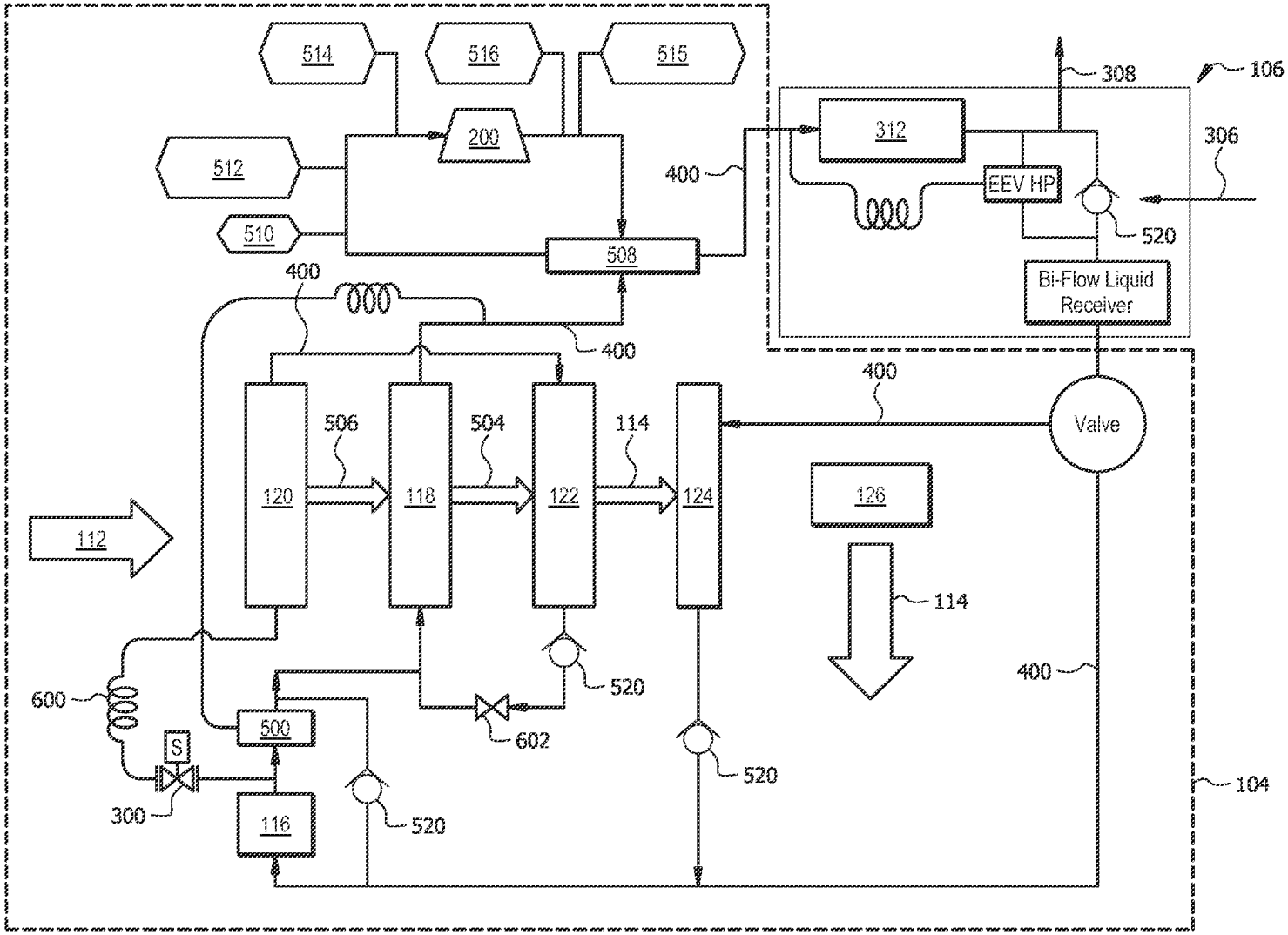
FIG. 6A illustrates a block diagram of the example modulating refrigeration system of FIG. 1 in a first mode of operation, according to certain embodiments.

FIG. 6A illustrates a block diagram of the example modulating refrigeration system 100 of FIG. 1 in a first mode of operation, according to certain embodiments. In embodiments, the first mode of operation may be the air conditioning and/or dehumidification mode. As seen in FIG. 6A, evaporation unit 104 includes the primary evaporator 118, the secondary evaporator 120, the secondary condenser 122, the compressor 200, the primary metering device 500, the optional sub-cooling coil 124, the first fan 126, first valve 300, the reversing valve 508, a capillary tube 600, and a differential pressure regulator 602, while condensing unit 106 includes the primary condenser 312. In another embodiment, the compressor 200 may be disposed within the condensing unit 106 rather than disposed within the evaporation unit 104.

Generally, primary evaporator 118, secondary evaporator 120, secondary condenser 122, compressor 200, primary metering device 500, optional sub-cooling coil 124, first fan 126, reversing valve 508, and primary condenser 312 operate similarly as they did as illustrated in FIG. 5A. However, FIG. 6A illustrates another embodiment of the first valve 300 operating with the differential pressure regulator 602. In this embodiment, the first valve 300 may be a solenoid valve disposed upstream of the primary metering device 500. The first valve 300 may be fluidly coupled to the secondary evaporator 120 via the capillary tube 600. In other embodiments, the capillary tube 600 may be any suitable fixed or variable orifice.

During this first mode of operation, the first valve 300 may be configured to direct a portion of the flow of refrigerant 400 discharged by the condensing unit 106 to the secondary evaporator 120. Further, the primary metering device may be configured to direct a remaining portion of the flow of refrigerant 400 discharged by the condensing unit 106 to the primary evaporator 118. The value of the portion directed to the secondary evaporator 120 may be determined based on operation of the differential pressure regulator 602. As illustrated, the differential pressure regulator 602 may be disposed downstream of the secondary condenser 122 and between the secondary condenser 122 and the primary evaporator 118. Actuating the differential pressure regulator 602 may vary the pressure along the secondary condenser 122 and secondary evaporator 120 and subsequently vary the amount of refrigerant 400 introduced through the first valve 300. For example, at a first position, the portion of the flow of refrigerant 400 directed to the secondary evaporator 120 may be 40% of the flow of refrigerant 400 discharged by the condensing unit 106. If the differential pressure regulator 602 is actuated to transition to a second position that increases the pressure along the secondary condenser 122 and secondary evaporator 120, the portion of the flow of refrigerant 400 directed to the secondary evaporator 120 may decrease due to the change in pressure (for example, to 35% of the flow of refrigerant 400 discharged by the condensing unit 106).

Modulating Refrigeration System with the Solenoid Valve in a Second Mode

Figure 6B:
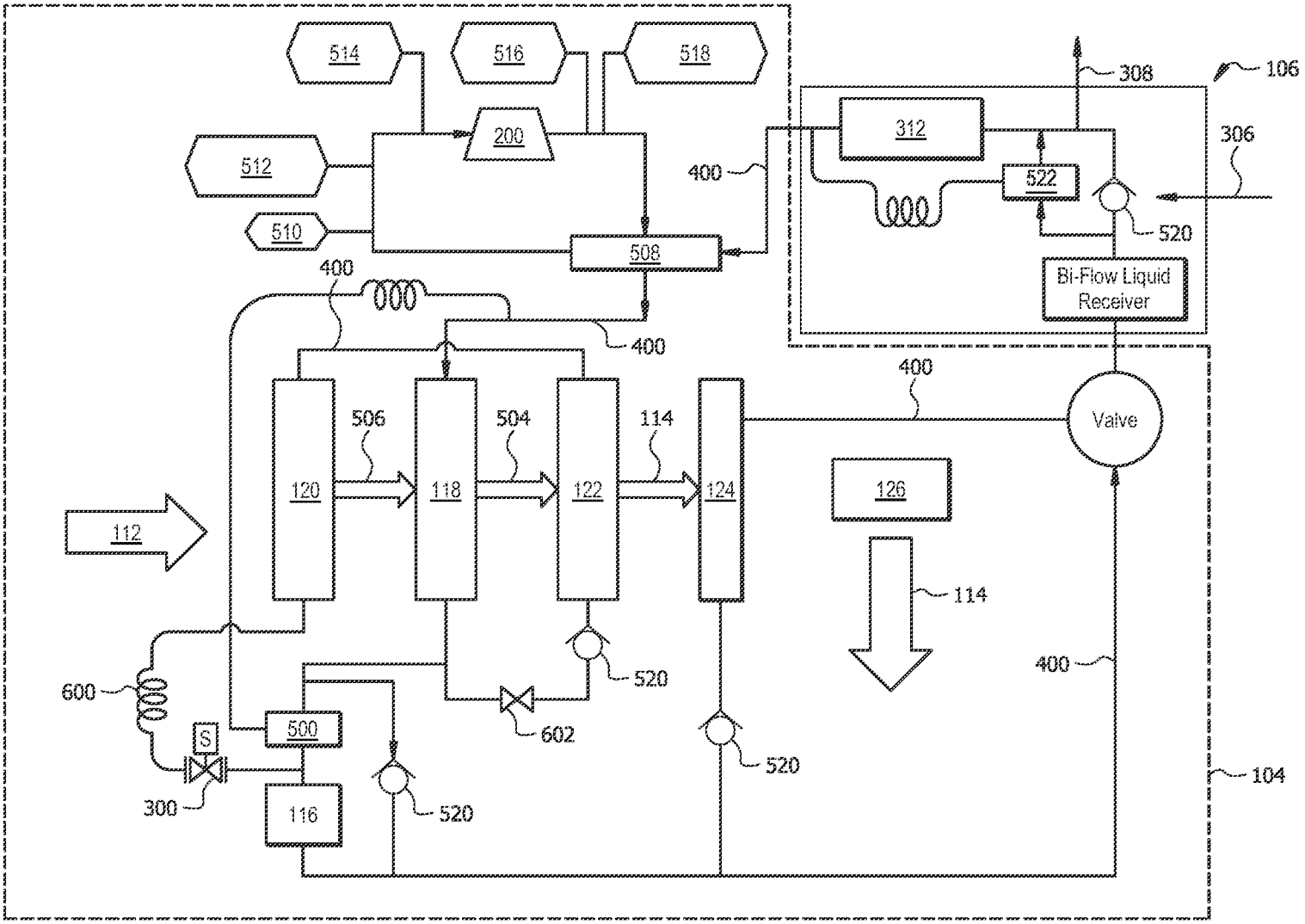
FIG. 6B illustrates a block diagram of the example modulating refrigeration system of FIG. 1 in a second mode of operation, according to certain embodiments.

FIG. 6B illustrates a block diagram of the example modulating refrigeration system 100 of FIG. 1 in a second mode of operation, according to certain embodiments. In embodiments, the second mode of operation may be a heat pump mode. As seen in FIG. 6B, evaporation unit 104 includes the primary evaporator 118, the secondary evaporator 120, the secondary condenser 122, the compressor 200, the primary metering device 500, the optional sub-cooling coil 124, the first fan 126, first valve 300, the reversing valve 508, the capillary tube 600, and the differential pressure regulator 602, while condensing unit 106 includes the primary condenser 312. In another embodiment, the compressor 200 may be disposed within the condensing unit 106 rather than disposed within the evaporation unit 104.

Generally, primary evaporator 118, secondary evaporator 120, secondary condenser 122, compressor 200, primary metering device 500, optional sub-cooling coil 124, first fan 126, first valve 300, reversing valve 508, and primary condenser 312 operate similarly as they did as illustrated in FIG. 6A. However, FIG. 6B illustrates the evaporation unit 104 and condensing unit 106 in the second mode of operation wherein the flow of refrigerant 400 is reversed compared to the flow of refrigerant 400 in FIG. 6A. In this manner, the first supply airflow 112 may be heated by the primary evaporator 118 to generate and output the first output airflow 114 with a higher temperature to be discharged into the structure. The present configuration further provides for mitigating additional cooling by the secondary condenser 122 by inhibiting flow of refrigerant 400 through the secondary condenser 122.

For example, the primary evaporator 118 may receive the flow of refrigerant 400 from the reversing valve 508. As the first supply airflow 112 flows past the primary evaporator 118, heat may transfer from the flow of refrigerant 400 to the first supply airflow 112 to generate the first output airflow 114 at a higher temperature. The flow of refrigerant 400 may then be discharged to flow towards the primary metering device 500 and to one of the one or more check valves 520 disposed between the primary evaporator 118 and secondary condenser 122. That one of the one or more check valves 520 may inhibit the flow of refrigerant 400 from being introduced into the secondary condenser 122, and the refrigerant 400 may flow towards the primary metering device 500. In embodiments, the primary metering device 500 may be in a closed position to inhibit the flow of the refrigerant 400 to flow through the primary metering device 500. The flow of refrigerant 400 may then bypass the primary metering device 500 and flow through one of the one or more check valves 520 disposed parallel to the primary metering device 500, wherein that check valve 520 discharges the flow of refrigerant 400 to an expansion device 522 used for heat pump mode and subsequently into condensing unit 106. The expansion device 522 may be similar to metering device 500 and provide bi-directional flow through the condensing unit 106. In embodiments wherein the primary metering device 500 supports bi-directional flow, the flow of refrigerant 400 may flow through the primary metering device 500 towards the condensing unit 106. In these embodiments, the parallel check valve 520 may not be needed within the evaporation unit 104. As the refrigerant 400 is discharged from the primary metering device 500, the first valve 300 may be in a closed position to inhibit the flow of refrigerant to secondary evaporator 120. During this second mode of operation, the reversing valve 508 may receive the flow of refrigerant 400 from the primary condenser 312 and direct the flow of refrigerant 400 to the compressor 200. The reversing valve 508 may then receive the flow of refrigerant 400 discharged by the compressor 200 and direct the flow of refrigerant 400 discharged by the compressor 200 back to the primary evaporator 118.

Although a particular implementation of the evaporation unit 104 and condensing unit 106 is illustrated and primarily described, the present disclosure contemplates any suitable implementation of the evaporation unit 104 and condensing unit 106, according to particular needs. Moreover, although various components of the evaporation unit 104 and condensing unit 106 have been depicted as being located at particular positions, the present disclosure contemplates those components being positioned at any suitable location, according to particular needs.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A modulating refrigeration system, comprising:

an evaporation unit disposed within a housing, comprising:

a secondary evaporator configured to:

receive a flow of refrigerant discharged by a primary condenser disposed external to the housing;

receive a first supply airflow introduced into the housing; and transfer heat from the first supply airflow to the flow of refrigerant as the first supply airflow passes through the secondary evaporator to generate a second airflow;

a first valve disposed upstream of the secondary evaporator configured to direct at least a first portion of the flow of refrigerant discharged by the primary condenser to the secondary evaporator;

a secondary metering device;

a primary evaporator configured to:

receive the flow of refrigerant from the secondary metering device or from the first valve;

receive the second airflow from the secondary evaporator; and transfer heat from the second airflow to the flow of refrigerant as the second airflow passes through the primary evaporator to generate a third airflow;

a primary metering device disposed upstream of the primary evaporator;

a secondary condenser configured to:

receive the flow of refrigerant from the secondary evaporator;

receive the third airflow from the primary evaporator; and transfer heat from the flow of refrigerant to the third airflow as the third airflow passes through the secondary condenser to generate a first output airflow; and a compressor configured to:

receive the flow of refrigerant from the primary evaporator and provide the flow of refrigerant to the primary condenser via a reversing valve, the flow of refrigerant provided to the primary condenser comprising a higher pressure than the flow of refrigerant received at the compressor;

the reversing valve disposed between the compressor, the primary evaporator, and the primary condenser, wherein during a first mode of operation, the reversing valve is configured to:

receive the flow of refrigerant from the primary evaporator and direct the flow of refrigerant to the compressor; and receive the flow of refrigerant discharged by the compressor and direct the flow of refrigerant discharged by the compressor to the primary condenser;

wherein during a second mode of operation, the reversing valve is configured to:

receive the flow of refrigerant from the primary condenser and direct the flow of refrigerant to the compressor; and receive the flow of refrigerant discharged by the compressor and direct the flow of refrigerant discharged by the compressor to the primary evaporator; and a condensing unit disposed external to the housing, comprising:

the primary condenser configured to:

receive the flow of refrigerant from the compressor; receive a second supply airflow; and transfer heat from the flow of refrigerant to the second supply airflow as the second supply airflow passes through the primary condenser to generate a second output airflow.

2. The modulating refrigeration system of claim 1, wherein the first valve is a three-way valve disposed between the primary metering device and the secondary evaporator, wherein during the first mode of operation, the first valve is configured to:

direct the first portion of the flow of refrigerant to the secondary evaporator; and direct a second portion of the flow of refrigerant to the primary evaporator.

3. The modulating refrigeration system of claim 2, wherein during the second mode of operation, the first valve is configured to:

receive the flow of refrigerant from the primary evaporator; and direct the flow of refrigerant to the condensing unit.

4. The modulating refrigeration system of claim 1, wherein the first valve is a solenoid valve disposed upstream of the primary metering device, wherein the first valve is fluidly coupled to the secondary evaporator, wherein during the first mode of operation:

the first valve is configured to direct the first portion of the flow of refrigerant discharged by the primary condenser to the secondary evaporator; and the primary metering device is configured to direct a second portion of the flow of refrigerant discharged by the primary condenser to the primary evaporator.

5. The modulating refrigeration system of claim 4, wherein during the second mode of operation:

the first valve is in a closed position configured to inhibit the flow of refrigerant; and the primary evaporator is configured to direct the flow of refrigerant to the condensing unit.

6. The modulating refrigeration system of claim 1, wherein the evaporation unit further comprises a sub-cooling coil configured to:

receive the flow of refrigerant from the primary condenser;

output the flow of refrigerant to the primary metering device; and transfer heat from the flow of refrigerant to the first output airflow as the first output airflow contacts the sub-cooling coil.

7. The modulating refrigeration system of claim 6, wherein two or more members selected from the group consisting of the secondary evaporator, the primary evaporator, the secondary condenser, and the sub-cooling coil are combined into a single coil pack.

8. A method of operating a modulating refrigeration system, comprising:

introducing a first supply airflow into an evaporation unit;

introducing a second supply airflow into a condensing unit; and during a first mode of operation:

directing a first portion of a flow of refrigerant from a first valve to a secondary evaporator in the evaporation unit;

directing a second portion of the flow of refrigerant from the first valve to a primary evaporator in the evaporation unit;

generating a second airflow by transferring heat from the first supply airflow to the first portion of the flow of refrigerant as the first supply airflow passes through the secondary evaporator;

receiving, by a secondary condenser in the evaporation unit, the flow of refrigerant from the secondary evaporator;

directing the flow of refrigerant from the secondary evaporator to the primary evaporator;

generating a third airflow by transferring heat from the second airflow to the flow of refrigerant as the second airflow passes through the primary evaporator;

generating a first output airflow by transferring heat from the third airflow to the flow of refrigerant in the secondary condenser;

receiving, by a compressor, the flow of refrigerant from the primary evaporator and providing a pressurized flow of refrigerant to the condensing unit; and transferring heat from the pressurized flow of refrigerant to the second supply airflow as the second supply airflow passes through the condensing unit to generate a second output airflow.

9. The method of claim 8, wherein the first valve is a three-way valve disposed upstream of the secondary evaporator, further comprising during a second mode of operation:

receiving, by the first valve, the flow of refrigerant from the primary evaporator; and directing the flow of refrigerant to the condensing unit.

10. The method of claim 8, wherein the first valve is a solenoid valve disposed upstream of the secondary evaporator, wherein the first valve is fluidly coupled to the secondary evaporator, further comprising during the first mode of operation:

actuating a differential pressure regulator disposed downstream of the secondary condenser and between the secondary condenser and the primary evaporator to change a pressure within the secondary condenser and the secondary evaporator.

11. The method of claim 10, further comprising during a second mode of operation:

directing the flow of refrigerant from the primary evaporator to the condensing unit, wherein the flow of refrigerant is prevented from flowing to the first valve.

12. The method of claim 8, further comprising:

actuating a reversal valve to transition the modulating refrigeration system from the first mode of operation to a second mode of operation; and during the first mode of operation:

receiving, by the reversal valve, the flow of refrigerant from the primary evaporator and directing the flow of refrigerant to the compressor; and receiving, by the reversal valve, the pressurized flow of refrigerant discharged by the compressor and directing the pressurized flow of refrigerant to the condensing unit.

13. The method of claim 12, further comprising during the second mode of operation:

receiving, by the reversal valve, the flow of refrigerant from the condensing unit and directing the flow of refrigerant to the compressor; and receiving, by the reversal valve, a flow of refrigerant discharged by the compressor and directing the flow of refrigerant to the primary evaporator.

14. An evaporation unit, comprising:

a secondary evaporator configured to:

receive a flow of refrigerant discharged by a primary condenser disposed external to a housing;

receive a first supply airflow introduced into the housing; and transfer heat from the first supply airflow to the flow of refrigerant as the first supply airflow passes through the secondary evaporator to generate a second airflow;

a first valve disposed upstream of the secondary evaporator configured to direct at least a first portion of the flow of refrigerant discharged by the primary condenser to the secondary evaporator;

a secondary metering device;

a primary evaporator configured to:

receive the flow of refrigerant from the secondary metering device or the first valve;

receive the second airflow from the secondary evaporator; and transfer heat from the second airflow to the flow of refrigerant as the second airflow passes through the primary evaporator to generate a third airflow;

a primary metering device disposed upstream of the primary evaporator; and a secondary condenser configured to:

receive the flow of refrigerant from the secondary evaporator;

receive the third airflow from the primary evaporator; and transfer heat from the flow of refrigerant to the third airflow as the third airflow passes through the secondary condenser to generate a first output airflow.

15. The evaporation unit of claim 14, wherein the first valve is a three-way valve disposed between the primary metering device and the secondary evaporator, wherein during a first mode of operation, the first valve is configured to:

direct the first portion of the flow of refrigerant to the secondary evaporator; and direct a second portion of the flow of refrigerant to the primary evaporator.

16. The evaporation unit of claim 15, wherein during a second mode of operation, the first valve is configured to:

receive the flow of refrigerant from the primary evaporator; and direct the flow of refrigerant to the primary condenser.

17. The evaporation unit of claim 14, wherein the first valve is a solenoid valve disposed upstream of the primary metering device, wherein the first valve is fluidly coupled to the secondary evaporator, wherein during a first mode of operation:

the first valve is configured to direct the first portion of the flow of refrigerant discharged by the primary condenser to the secondary evaporator; and the primary metering device is configured to direct a second portion of the flow of refrigerant discharged by the primary condenser to the primary evaporator.

18. The evaporation unit of claim 17, wherein during a second mode of operation:

the first valve is in a closed position configured to inhibit the flow of refrigerant; and the primary evaporator is configured to direct the flow of refrigerant to the primary condenser.

19. The evaporation unit of claim 14, further comprising a sub-cooling coil configured to:

receive the flow of refrigerant from the primary condenser;

output the flow of refrigerant to the primary metering device; and transfer heat from the flow of refrigerant to the first output airflow as the first output airflow contacts the sub-cooling coil.

20. The evaporation unit of claim 19, wherein two or more members selected from the group consisting of the secondary evaporator, the primary evaporator, the secondary condenser, and the sub-cooling coil are combined into a single coil pack.

* * * * *